United States Patent [19]

Cambardella

[11] 4,070,026

[45] Jan. 24, 1978

[54] BOARD GAME APPARATUS

[76] Inventor: Nicholas A. Cambardella, 3660 Crest Road, Wantaugh, N.Y. 11793

[21] Appl. No.: 716,194

[22] Filed: Aug. 20, 1976

[51] Int. Cl.[2] ..... A63F 3/04

[52] U.S. Cl. ..... 273/254; 273/146; 273/243

[58] Field of Search ..... 273/134, 146

[56] References Cited

U.S. PATENT DOCUMENTS

| | | | |
|---|---|---|---|
| 3,556,528 | 1/1971 | Spiring | 273/134 AC |
| 3,947,038 | 3/1976 | Archer | 273/134 AC |

FOREIGN PATENT DOCUMENTS

| | | | |
|---|---|---|---|
| 820,991 | 8/1937 | France | 273/146 |
| 899,808 | 9/1944 | France | 273/134 AC |
| 860,162 | 12/1952 | Germany | 273/146 |
| 8,374 of | 1894 | United Kingdom | 273/134 AC |
| 979,214 | 1/1965 | United Kingdom | 273/134 AC |

*Primary Examiner*—Delbert B. Lowe
*Attorney, Agent, or Firm*—Roberts & Cohen

[57] ABSTRACT

A game is provided with a map board subdivided into a plurality of territorial entities such as geographical or political entities, such as the states of the United States of America. Each state is assigned a value corresponding to, for example, its population. A grid of recesses is provided on the top surface of the game board which allows for the movement of game pieces therealong. The grid of recesses is formed into a plurality of vertical rows and a plurality of horizontal rows, and the game pieces move therealong a distance equal to a number shown by a first-game-piece control member, such as an eight-sided die, while the direction of movement of the game pieces along the grid of recesses is also determined by a game-piece control member, such as a second eight-sided die which has a plurality of directions indicated on the surfaces thereof. A state is claimed by any player whose game piece lands in a recess within the boundary of the state. The recesses are such as to minimize interference with the appearance of the board and to minimize erosion of the recesses by the game pieces.

15 Claims, 6 Drawing Figures

BOARD GAME APPARATUS

FIELD OF THE INVENTION

The present invention is directed to games for amusement and educational purposes and, more particularly, to games of the type which utilize a gam board, a plurality of game pieces for movement along the top surface of the game board, and game-piece control members, such as a pair of dice.

BACKGROUND OF THE INVENTION

Games which employ game boards and game pieces for movement along the top surface of the game board are well-known and numerous. Examples of such prior art are shown in U. S. Pat. Nos. 459,952; 1,065,775; 1,302,805; 2,070,608; 2,277,301; 3,495,831; 3,495,833; 3,614,105; 3,642,286; 3,638,946; 3,905,602; and 3,947,038. French Pat. No. 1,090,757 also shows such a game.

Games which show the use of dice in order to control the outcome of the game are also well-known, examples of these being shown by U. S. Pat. Nos. 2,922,652; 3,198,523; 3,208,754; and 3,495,832.

In the prior art, the movement of a game piece along a top surface of a game board is not, at all times, controlled in both the distance and direction moved. Typically, the game piece is moved along a fixed path as predetermined by the game plan, the only variable being the distance moved along the board which typically is controlled by a die or a pair of dice or the like. U.S. Pat. No. 3,947,038 incorporates therein a compass spinner which determines the direction of movement of a game piece. However, this occurs only when a game piece lands in a certain designated area so that direction control is not always present in the game.

SUMMARY OF THE INVENTION

It is a primary object of the present invention to provide a game for educational and amusement purposes in which gamepiece movement is at all times controlled by directional and distance control means such that the movement of the game pieces may take one of a multitude of discrete paths.

It is another object of the invention to provide an interesting and educational game that has the simple advantages of determining a winner by chance.

Further, it is an object to provide an educational game which teaches the directional aspects of a compass and skills pertaining to geography.

Another object is to provide a distinctive primary game movement of a specific directional and distance nature.

To this end, the game of the present invention is comprised of a game board having a top surface and a bottom surface, the top surface having formed thereon a map of, for example, the United States of America along with its subdivisions of fifty states. The top surface is also formed with a grid of recesses that form a plurality of horizontal rows of recesses and a plurality of vertical rows of recesses, so that the distance between adjacent recesses in a row is equal. The game is also provided with a plurality of game pieces, preferably four in number, which are used by the players of the game to travel along the grid system and thereby along the map and along the various political subdivisions or states thereof. The grid system of recesses is preferably so designed that at least one recess is confined within the boundary of or associated with every political subdivision. The conclusion of one move of any one of the game pieces to a position within an unclaimed political entity or subdivision identifies a section which may be claimed by the player corresponding to that game piece. The path of travel of any one game piece is determined by a game piece control means, preferably a pair of dice. The control means determines the number of spaces a game piece is to be advanced, each space corresponding to the distance between any two adjacent recesses within the grid system, whether in the horizontal, vertical or diagonal direction. The control means also determines the direction of travel of the game piece, and preferably allows for the direction of travel in any one of eight possible directions: North, South, East, West, Northeast, Northwest, Southeast, and Southwest.

The game is played by first setting up the game pieces at a starting location arranged within the map, and which is delineated by the four corners of a box. Each player, in his turn, then utilizes the game piece control means to determine his particular path of travel and distance. If, in his move, the game piece lands within a political subdivision which has not been claimed, he may claim it and add to his score that value indicated on the map for that particular political subdivision. If his game piece lands within a political subdivision already claimed by another player, he is required to pay a fee thereon with play money provided with the game. If the political entity has value less than a certain value, no fee is required to be paid if landed in by any game piece other than that of the claimant or owner of the political subdivision. The game is played until all of the political subdivisions have been claimed, or until one player is unable to pay the fee due on a political subdivision on which his game piece has landed. The score for each player is derived by counting up all his play money along with the total value of all the political subdivisions claimed by him.

The grid system of recesses, by which the game pieces advance and are held in place, may include recesses which have a depth less than the thickness of the game board so that the recesses terminate before reaching the bottom surface thereof. Each of the game pieces has a length or extension less than the depth of the recesses so that they do not contact the bottom surfaces of the recesses, which may mar or discolor or otherwise erode these surfaces. Significantly, an arrangement of recesses in this manner provides for a visual continuity of a color map projection (i.e., the map does not appear to have dark holes in it).

Also provided with the game are a plurality of stake pieces which fit into slots or openings formed on the top surface of the game board within the boundaries of the political subdivisions, one slot being provided for each political subdivision. The stake pieces may be provided in different colors corresponding to the colors of the game pieces so that instant identification as to who owns a particular political subdivision is provided. Alternatively, each stake piece may have a plurality of differently-colored surfaces which may be used by each player with his particular colored surface facing upwardly when claiming a political subdivision. Through use of this invention, geographical locations of states, as well as particular characteristics of these states, may be readily learned.

BRIEF DESCRIPTION OF THE DRAWING

The invention will be more readily understood with reference to the following detailed description, when taken in conjunction with the accompanying drawing, wherein.

DETAILED DESCRIPTION OF THE INVENTION

Figure 1:
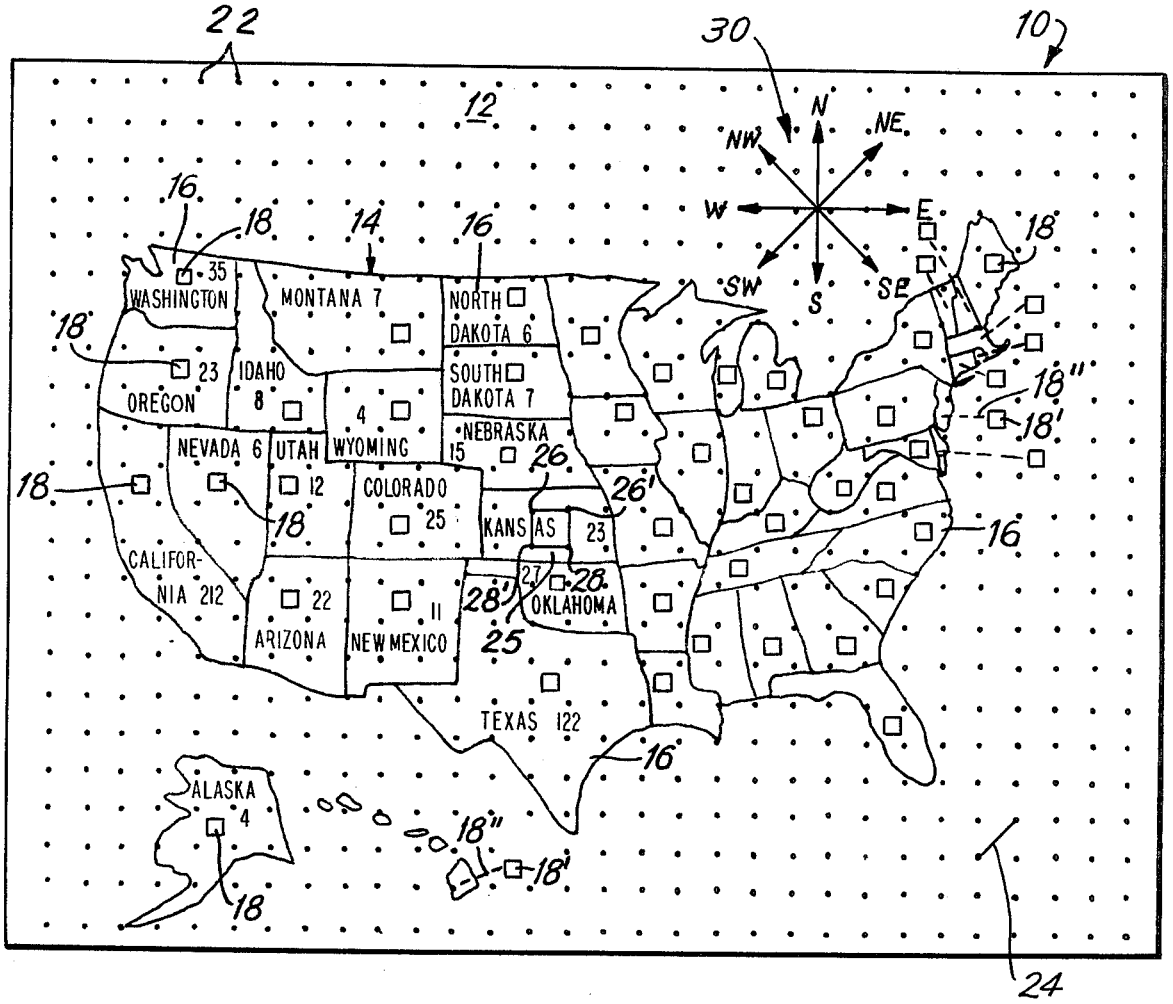
FIG. 1 is a plan view showing the game board of the present invention with the map of the United States of America thereon.

Referring now to the drawing, there is shown in FIG. 1 the game board 10 of the invention. The game board 10 may be made of paper, wood, cardboard or any suitable plastic and has a top planar surface 12 and a parallel spaced bottom surfaces (not shown). Printed in color or otherwise placed on the top surface 12 is a map 14 which is, in the illustrated version, a map of the United States of America, but which may be of any other country or the like. Although a map with political entities is shown in the preferred embodiment, the scope of the invention covers entities of diverse types such as, for example, geographic and territorial. Thus, reference hereinafter to political entities is for purposes of illustration, and substitution may be made of other types of entities as well. By way of definition, generic reference will be made to "territorial entities."

The map 14 is subdivided into the various political entities 16 of the particular country involved, and in the preferred form of the invention shown in FIG. 1 these political entities are the fifty states of the United States of America. Some of these states are identified in the drawing by way of example. Within the boundary of each of most of the political entities, there is provided a rectangular or square opening or slot 18 which receives therein a stake piece (to be described below) which indicates that the particular state is "claimed" by a player. Since there are some states that are too small to allow for an opening 18 within the boundaries thereof, openings 18' are provided which lie outside the boundaries of the associated political entity and which have a reference line 18'' extending from the opening 18' to the particular state to which the opening belongs. In FIG. 1, such openings 18' are shown, for example, for the states Hawaii and New Jersey.

The top surface 12 is also provided with a grid system of recesses 22 which form a plurality of horizontal rows of recesses 22 and a plurality of vertical rows of recesses 22. The recesses 22 in any one vertical or horizontal row are equally spaced, but the distance along a diagonal, such as indicated by reference character 24, is greater than the distances between any two adjacent recesses positioned in any horizontal or vertical row. The boundaries of the political entities 16 are preferably so drawn as to insure that at least one, and preferably a plurality, of the recesses 22 are contained within the boundary of every political entity or state 16. This is to insure that every state can be claimed, although it should be understood that the smaller the area of a particular state, the more difficult it is for a particular claim to be made thereof, all other conditions remaining the same. In some embodiments, some entities may be without recesses in which event they may be claimed or otherwise dealt with along with an adjacent state.

Each political or territorial entity or state 16 is assigned a relative value or number (some of which are illustrated by way of example) which may be determined by some formula or objective measure of some general characteristic such as the population of the state according to the 1970 census. Alternatively, the value assigned to the state may be determined by its area, with Alaska obtaining the largest value, Texas the second largest value, and Rhode Island the least value of all of the states. Furthermore, the values may be determined according to the probability of a particular game piece landing in the particular state, a smaller probability corresponding with a higher value for the particular state. Since the values for which the states are assigned may be changed, the game of the present invention may serve as an educational device by assigning to the states those values which correspond to a particular measure to be learned. For example, if it is desired to teach the population of the states of the United States of America, then by assigning to the states values equal to their population a player, by playing this game, may learn these populations. Of course, other characteristics may be learned, such as the square mileage of the states, order of succession to statehood, etc. These will be learned by assigning particular values to the states according to the rank thereof.

Also provided on the top surface 12 is a directional legend 30 indicating the various directions in which a game piece (to be described below) may move.

The recesses 22, which form the grid system, extend downwardly from the top surface 12 toward the bottom surface (not shown) to about midway between the two surfaces. The recesses have a diameter correlated with the depth thereof, so that when the game board 10 is exhibited, a continuous top surface is characterized by a continuous appearance. For deeper recess designs, the diameter is greater to avoid shadows. The diameter is at least about 1.5 times the recess depth. To provide for continuous appearance, map coloring extends completely into all recesses 22 and slots 18 and at least substantially covers the surfaces within the same.

Figure 5:
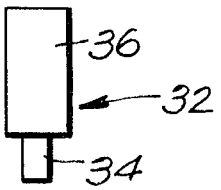
FIG. 5 is a side view showing one of the plurality of game pieces of the present invention.

FIG. 5 shows one of a plurality of game pieces used in the present invention. The game piece 32 is made of a main body portion 34 of elongated nature which is received in a recess 22 of similar shape. It is preferably circular, but is may be of any cross-section desired. The game piece 32 also has a top portion 36 of greater expanse than said main body portion 34 and recess 22, so as to limit the insertion of the main body portion 34 into any recess 22. Preferably, the main body portion 34 is of a lesser expanse than recess 22 by a minimum of 10% so that the game piece 32 may be easily inserted and removed from the recess, and so that any marring or discoloring or other such eroding of the bottom surface of the recess is avoided.

In the preferred form of the invention, there are four such game pieces provided, with each game piece taking on a different color in order to distinguish one from another. Each game piece is initially positioned at the starting location on the game board 10 indicated generally by reference character 25. The starting location 25 may be square-shaped with the four corners thereof, indicated by reference characters 26, 26', 28 and 28', constituting the initial positioning of the four game pieces.

Figure 2:
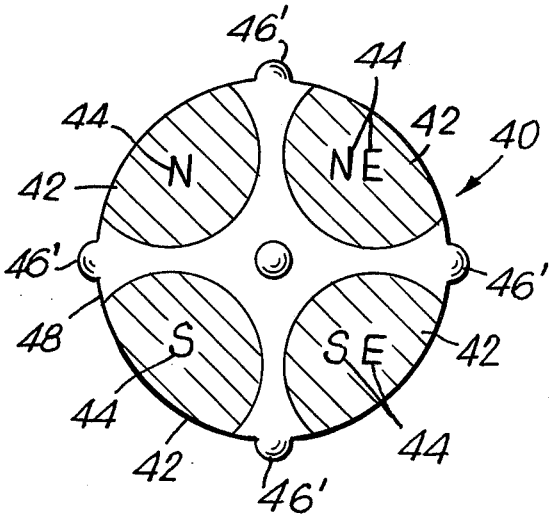
FIG. 2 is a top plan view showing a first or directional die of the present invention.
Figure 4:
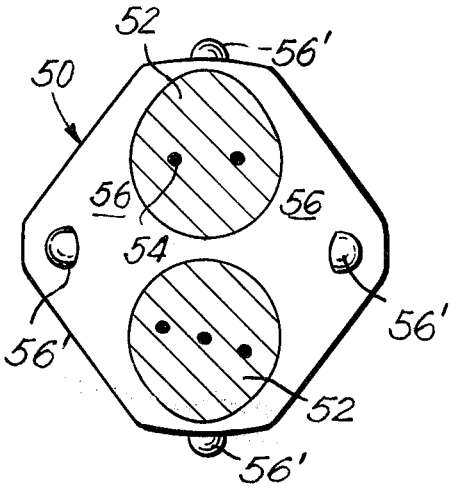
FIG. 4 is a side view of the second or distance die of the present invention.
Figure 3:
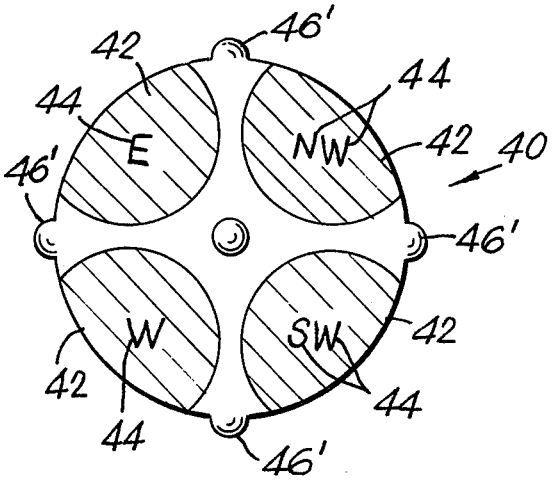
FIG. 3 is a bottom plan view showing the first directional die of the present invention.

FIGS. 2–4 show the pair of dice or game piece control members which control the movement of the game pieces 32. The first or directional die 40 is shown in FIGS. 2 and 3, and the second or distance die 50 is shown in FIG. 4, it being understood that the dice 40 and 50 are identical in shape and configuration, with the only difference being the matter printed on the facets or surfaces thereof.

The dice 40 and 50 are preferably in the shape of an octahedron, so that eight facets or surfaces are provided. Four surfaces are above the center bisecting plane and four surfaces are below the center bisecting plane. The center bisecting plane constitutes the dividing plane between the pair of imaginary tetrahedrons which make up the octahedron.

Each of the surfaces 42 of the die 40 has thereon a letter or letters indicating one direction from the group North, South, East, West, Northeast, Northwest, Southeast and Southwest. In FIGS. 2 and 3, it can be seen that the directions are shown by characters 44.

The die 40 has each facet or surface 42 separated from the other facets or surfaces 42 in such a way that the spaces therebetween are rounded into curved smooth surfaces indicated by reference character 48. Each surface or facet 42 is preferably of a flat circular shape so that the smooth surfaces 48 have a greater area between four of said surfaces 42 than between two of the surfaces 42. Such a configuration aids in the rolling action of the dice since a circular cross-section is approximated by the die, as indicated by reference character 48. In order to prevent the die 40 from ending up, after being rolled, on a smooth surface 48, a plurality of hemispherical projections 46' are provided, the number of projections 46' equalling the number of smooth surfaces 48, which in the embodiment shown is six.

The second or distance die 50 is exactly the same as the directional die 40, with the only exception being that on its surfaces or facets 52 there is provided at least one dot 54. The eight surfaces 52 have thereon from one to eight dots indicating the number of steps a game piece of the player rolling the die may take, a step being equal to the distance between any two adjacent recesses 22, whether in the horizontal, vertical or diagonal direction. The die also has, as does the die 40, hemisperical projections 56' for the smooth surfaces 56.

Figure 6:
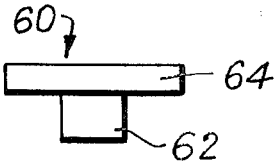
FIG. 6 is a side view showing one of the plurality of stake pieces of the present invention.

FIG. 6 shows one of the plurality of stake pieces 60 for insertion into the openings or slots 18 on the top surface 12 of the game board 10. Each stake piece 60 has a main body portion 62 of square cross-section for projection into an opening 18, and a top portion 64 of any desired geometric form but of greater expanse than the main body portion 62 to limit the downward movement of the main body portion 62 in an opening 18. The minimum transverse dimension of opening 18 is preferably 1.5 times the depth thereof. Preferably, the main body portion 62 is of less expanse than opening 18 by at least 10% so that it may be readily inserted into and removed therefrom, and so that the marring or discoloring or other eroding of the bottom surface of the opening 18 is prevented. There are preferably fifty stake pieces for each player, one stake piece for each state, when the map is that of the United States of America. Each group of fifty stake pieces is of a separate color which is coordinated with one game piece. If the maximum number of players allowed to play, as in the preferred form of the invention, is four, then there are provided a total of four groups of stake pieces, or a total of 200 stake pieces, when the map is that shown in FIG. 1.

In an alternative form of the invention, there may be provided instead of the single-colored stake pieces 60, a plurality of stake pieces of a cube form where each stake piece has a plurality of differently-colored surfaces thereof. With, for example, six players playing the game of the invention, each stake piece would have six surfaces, each surface being of a different color and coordinated with the colors of the game pieces. Therefore, when using the stake pieces with the map shown in FIG. 1, only fifty such stake pieces need be provided. Each surface of the stake piece in the alternative embodiment has a projection similar to the main body portion 62 of stake piece 60, so that a selected one of the surfaces would be positioned face-up when a claim is made for a state.

The preferred game played with the game apparatus shown is described below.

The game is preferably played with two to four players. In order to begin playing the game, the players first elect a director who simply performs a fixed administrative function and obtains no advantage as a director, the director being one of the players or a bystander.

The rules of the games are summarized as follows:

1. The players position themselves on the northern, eastern, southern, and western sides of the game board and each player selects an individual color game piece and places it into one of the starting position corner recesses 26, 26', 28, 28';

2. The director then distributes a thousand dollars of play money of various denominations to each player and also distributes an appropriate number of colored stake pieces to each player;

3. After determining (such as by rolling the distance die) who is to move first, a player's turn or "game move" involves casting the playing dice and moving the game piece on the board in the specified direction and specified distance as determined by a reading of the dice settings. Play continues in a clockwise rotation for each player's turn;

4. If a player's move terminates at a recess occupied by an opponent's game piece, this game piece is thereby displaced and must be placed back into one of the starting positions. Also, if a game move calls for moving the game piece beyond the outer perimeter of the grid or recesses of the game board, again the player's game piece is displaced back to one of the starting position corner recesses;

5. The first player to enter into and terminate the game move in an unclaimed state may "stake a claim" to such state by placing a stake piece in the allocated opening and the state is now claimed or owned by the player;

6. If a player enters into and terminates the move in a state owned by an opponent player, a "trespassing fee" must be paid to the opponent player. The fee amount is equivalent to the state value in a dollar amount. A fee is paid only when a player enters into and terminates his move in a given claimed state, not if the player started the game move in the claimed state. The exception to this rule are those claimed states of a state value of ten or less, in which case "free passage" is granted to a player whose move terminates in such a state;

7. If a player is unable to pay the fee amount due to another player because of a lack of money, the player in default "unclaims" or disclaims those states owned in which the sum total value either equals or exceeds the amount due. Accordingly, the player in debt removes the stake pieces from such states resulting in unclaimed states and receives the monetary equivalent from the director, who obtains the money from the cash tray. Now, the player in debt pays the amount due to the other player and retains the remaining amount, if any;

8. If a player happens to be in a state that was just unclaimed by another player, the player cannot claim such state, unless, of course, the player's move enters into and terminates in such state;

9. On a player's turn and before the dice are cast, a player may issue an optional call in predicting the outcome of the directional die. If the call is correct, the player receives an additional turn. Some element of skill is involved in exercising this optional call; conceivably, a player would choose the optional call in the early game stages when many of the states are unclaimed, rather than in the later game stages when many of the states are claimed;

10. An additional rule is that, on a player's turn, if the dice cast results in a distance die value of eight, an override or super claim is in force. When a player with an override claim terminates the game move in a state already owned by an opponent player, the player displaces the opponent's stake piece with his or her stake piece, thus, a transfer of state ownership takes place. This rule adds a desirable degree of tension and interest to the game, and may alter the predicted game winner right up to the final game play.

11. The winner of the game is decided at the time a game termination condition is present. The two termination conditions are either there are no more states on the board to be claimed or owned by the players or a player cannot pay a fee amount due to another player due to a lack of money and states left to unclaim. Each player tallies up the amount of play money owned and the state value total of all states owned. The player with the highest number is declared the winner of the game.

Numerous modifications of and changes to the invention may be made without departing from the scope and spirit thereof. For example, the recesses 22 may be represented by circular markings on the top surface of the game board 10 made of paper and the like. Also, the recesses may be formed in a clear plastic sheet covering the game board. The game pieces and stake pieces may also include magnetized components which interact with magnetized components in the recesses of the game board, or the representations of the recesses of the game board. Further, the stake pieces may, instead of being in the afore-described configuration, be in the shape of a cube with six colored surfaces. In this embodiment, the stake cubes are positionable on the top surface 12 without the use of openings 18. In addition, the value assigned to a particular political entity or state 16 may be determined by roll of the distance die 50. For example, upon the landing in a particular political entity 16 by a game piece 32, the player woul then roll the distance die 50 and multiply the value shown on the die by 10 to arrive at the value of that particular state 16. Further, instead of the pair of dice 40, 50, one or a pair of spinners may be used as the game piece control means, with the probability of achieving a specified value or path the same as that with the pair of dice 40, 50.

There will now be obvious to those skilled in the art many modifications of the structures set forth above. These modifications will not depart from the scope of the invention if defined by the following claims.

What is claimed is:

1. A game for two or more players comprising: a game board having a top surface and a bottom surface, said top surface having a map formed thereon, said map being divided into a plurality of individual territorial entities; a plurality of game pieces for movement along said map in discrete steps, one game piece for each player; and game piece control means for controlling the movement of said game pieces along said map, said game piece control means determining the distance moved along a portion of said map and the direction of movement of a game piece along said map, said top surface of said game board also having means thereon for guiding said game pieces therealong in the direction and distance determined by said game piece control means, each of said territorial entities of said map having formed thereon a number indicating its value for the game, said value being determined by a formula relating a general characteristic of all the territorial entities to each territorial entity, so that a ranking thereof may be derived.

2. A game as claimed in claim 1 wherein said game piece control means includes first and second game piece control members respectively controlling distance and direction.

3. The game according to claim 2, wherein said game-piece control members are a pair of dice, each of said pair of dice being an octahedron and comprising eight facets, each of said facets being separated from an adjacent facet so as to form a plurality of curved smooth surfaces therebetween, each of said curved smooth surfaces having a hemisperically-shaped projection extending therefrom.

4. The game according to claim 1, wherein said means for guiding said game pieces along said map comprises a grid system of recesses formed in said top surface, said grid forming a plurality of horizontal rows of recesses and a plurality of vertical rows of recesses, each recess in a row being equidistantly spaced from an adjacent recess in that row, said recesses being so dimensioned and arranged as to minimize interference with the appearance of said map, at least a majority of said plurality of territorial entities each having at least one of said recesses therein, whereby said game pieces move along said recesses in the direction and for a distance as determined by said game-piece control means.

5. The game according to claim 4, wherein each recess extends from said top surface downwardly toward said bottom surface and terminates approximately midway therealong.

6. The game according to claim 5, wherein each of said game pieces has a main body portion for projection into one of said recesses, said main body portion having a length less than the distance said recess extends downwardly from said top surface toward said bottom surface, so that the bottom surface of said recess does not become marred or discolored.

7. The game according to claim 6, wherein each of said game pieces further comprises a top portion having an expanse greater than that of a recess, so as to limit the downward movement of said main body portion into said recess, said main body portion having an expanse less than that of a recess so as to enable the easy insertion and removal of said game piece from said recess.

8. The game according to claim 6, wherein said one of said pair of dice comprises on each of its plurality of surfaces means for indicating the distance a game piece is to be moved, and said other of said pair of dice comprises on each of its plurality of surfaces means for indicating the direction the game piece is to be moved along said map.

9. The game according to claim 8, wherein each of said pair of dice has eight surfaces, said means for indicating formed on each of said surfaces of said one of said pair of dice comprising at least one marker corresponding to one step equal to the distance between a pair of adjacent of said recesses, said means ranging in value from one to eight on said plurality of surfaces of said one of said pair of dice.

10. The game according to claim 9, wherein said means for indicating on each of said plurality of surfaces of said other of said pair of dice comprises a symbol for one direction selected from a group comprising the directions North, South, East, West, Northeast, Northwest, Southeast and Southwest, said means for indicating on one of said plurality of surfaces of said other of said pair of dice having a direction selected from said group different from any other of said means for indicating on the other of said plurality of surfaces of said other of said pair of dice.

11. The game according to claim 4, wherein said game piece control means comprises a pair of dice, each of said pair of dice having a plurality of surfaces, one of said pair of dice being adapted for determining the distance a game piece is moved along said map, and the other of said pair of dice being adapted for determining the direction of movement of the game piece along said map.

12. The game according to claim 1, wherein said map is a map of the United States of America, and said individual territorial entities are the fifty states of the United States of America.

13. The game according to claim 1, wherein said map further comprises a direction legend indicating the directions corresponding to the directions of said game-piece control means.

14. The game according to claim 1, wherein each of said territorial entities has associated therewith a slot, said game further comprising a plurality of groups of stake pieces for insertion into the slot, so that a territorial entity may be claimed by a player upon his landing therein with his game piece, one said group being provided for each game piece, each said group having a color corresponding to one game piece.

15. The game according to claim 1, wherein said top surface comprises a starting location for the initial positions of the game pieces at the start of the game, said starting location comprising a square-shaped box having four corner positions for the initial locations of the game pieces, said starting location being positioned within the boundaries of said map.

* * * * *